US010532793B2

(12) United States Patent
Lagarrigue et al.

(10) Patent No.: US 10,532,793 B2
(45) Date of Patent: Jan. 14, 2020

(54) MOTOR BOAT WITH RETRACTABLE FOILS

(71) Applicant: Hydros Innovation SA, Lausanne (CH)

(72) Inventors: Jérémie Lagarrigue, Bavois (CH); Jean-Mathieu Bourgeon, Plouharnel (FR)

(73) Assignee: Hydros Innovation SA, Lausanne (CH)

( * ) Notice: Subject to any disclaimer, the term of this patent is extended or adjusted under 35 U.S.C. 154(b) by 0 days.

(21) Appl. No.: 15/326,657

(22) PCT Filed: Jul. 17, 2015

(86) PCT No.: PCT/IB2015/055444
§ 371 (c)(1),
(2) Date: Dec. 3, 2017

(87) PCT Pub. No.: WO2016/009409
PCT Pub. Date: Jan. 21, 2016

(65) Prior Publication Data

US 2018/0201343 A1 Jul. 19, 2018

(30) Foreign Application Priority Data

Jul. 17, 2014 (WO) ..... PCT/IB2014/063175

(51) Int. Cl.

| | |
|---|---|
| ***B63B 1/30*** | (2006.01) |
| ***B63H 20/10*** | (2006.01) |
| ***B63B 1/24*** | (2006.01) |
| ***B63H 20/00*** | (2006.01) |
| ***B63H 20/08*** | (2006.01) |

(52) U.S. Cl.
CPC ..... *B63B 1/30* (2013.01); *B63B 1/246* (2013.01); *B63H 20/007* (2013.01); *B63H 20/08* (2013.01); *B63H 20/106* (2013.01)

(58) Field of Classification Search
CPC ..... B63B 1/28; B63B 1/30; B63B 2001/28
USPC ..... 114/278, 280, 282
See application file for complete search history.

(56) References Cited

U.S. PATENT DOCUMENTS

| | | | | |
|---|---|---|---|---|
| 2,991,747 A * | 7/1961 | Bader | B63B 1/30 114/282 |
| 3,081,728 A | 3/1963 | Wilterdink et al. | |
| 3,150,626 A | 9/1964 | Irgens | |
| 3,345,968 A * | 10/1967 | Bailey | B63B 1/285 114/280 |
| 3,763,811 A | 10/1973 | Danahy | |

(Continued)

OTHER PUBLICATIONS

English Translation of International Preliminary Report on Patentability (IPRP) for PCT/IB2015/055444, dated Jan. 26, 2017.

*Primary Examiner* — Daniel V Venne
(74) *Attorney, Agent, or Firm* — Andre Roland S.A.; Nikolaus P. Schibli

(57) ABSTRACT

The invention relates to a motor boat comprising a bearing structure (1) and at least one foil (2) which is defined by a hydrofoil and its support (4), which is positioned under said structure and slideably mounted with respect to the latter; characterized in that the foil (2) is also mounted in such a way as to adopt at least two fixed positions, namely a position referred to as the active position in which the foil (2) is lowered and a position referred to as the passive position in which the foil (2) coincides with the bearing structure (1) or is fully retracted into the latter.

8 Claims, 6 Drawing Sheets

(56) References Cited

U.S. PATENT DOCUMENTS

| | | | | |
|---|---|---|---|---|
| 4,058,076 | A * | 11/1977 | Danahy | B63B 1/30 114/129 |
| 4,955,312 | A | 9/1990 | Magazzu | |
| 5,054,410 | A | 10/1991 | Scarborough | |
| 5,988,097 | A | 11/1999 | Kamey et al. | |
| 6,095,076 | A | 8/2000 | Nesbitt | |
| 6,499,419 | B1 | 12/2002 | Bussard | |
| 6,782,839 | B1 * | 8/2004 | Nozaki | B63B 1/20 114/280 |
| 8,201,514 | B2 * | 6/2012 | Coles | B63B 1/20 114/283 |
| 8,720,354 | B2 | 5/2014 | Ketterman et al. | |
| 8,967,063 | B2 | 3/2015 | Coffman | |
| 2009/0013917 | A1 | 1/2009 | Ulgen | |
| 2012/0255479 | A1 | 10/2012 | Sahlin | |
| 2012/0325135 | A1 | 12/2012 | Ketterman et al. | |
| 2014/0009820 | A1 | 1/2014 | Park | |

* cited by examiner

MOTOR BOAT WITH RETRACTABLE FOILS

CROSS REFERENCE TO RELATED APPLICATIONS

The present application is a United States national stage application of International patent application PCT/IB2015/055444 filed on Jul. 17, 2015 designating the United States, and claims foreign priority to International patent application PCT/IB2014/063175 filed on Jul. 17, 2014, the contents of both documents being herewith incorporated by reference in their entirety.

FIELD OF THE INVENTION

The present invention relates to motorized boats with foils.

PRIOR ART

The principle consisting in balancing the weight of a boat by a hydrodynamic lift effect produced by the speed of the water acting on elements in the form of wings which are submerged, semi-submerged or traverse the surface of the water, as opposed to using the Archimedean effect of submerged volumes alone, is relatively old. From the start of the twentieth century, there have been motor boats equipped with this type of device known as a foil. Additionally known is the use of foils with the aim of stabilizing vessels in terms of rolling or pitching in Archimedean configuration. The use of foils improves the performance of boats by increasing the speed and/or reducing energy consumption.

American U.S. Pat. No. 4,237,810 discloses a motor boat equipped with foils.

In this boat, and more generally in motorized boats with foils, the position of the foils with respect to the bearing structure does not vary, whether the boat is at a standstill, is moving at a low or high speed or whether the force of the wind or the height of the waves is pronounced or not.

Other patents, such as American U.S. Pat. No. 3,241,511, disclose principles of motor boats with foils with a system for the retractability of the foils by means of vertical sliding or by various rotation mechanisms. These systems make it possible in particular to relatively reduce the overall size and the drag of the appendages when they are not used.

However, the prior art devices do not make it possible to satisfy two precise distinct geometric configurations, namely (i) the coincidence of the foils in the raised position with the shape of the hull, and (ii) the positioning of the foils in the lower position which makes it possible to naturally obtain the autostability of the hydrofoil in flight, be this in rolling or in pitching.

SUMMARY

The present invention relates to a hybrid motor boat with foils, that is to say one being able to navigate in Archimedean configuration or "to foil" and change configuration during navigation.

DESCRIPTION OF THE SEVERAL EMBODIMENTS

Figure 1:
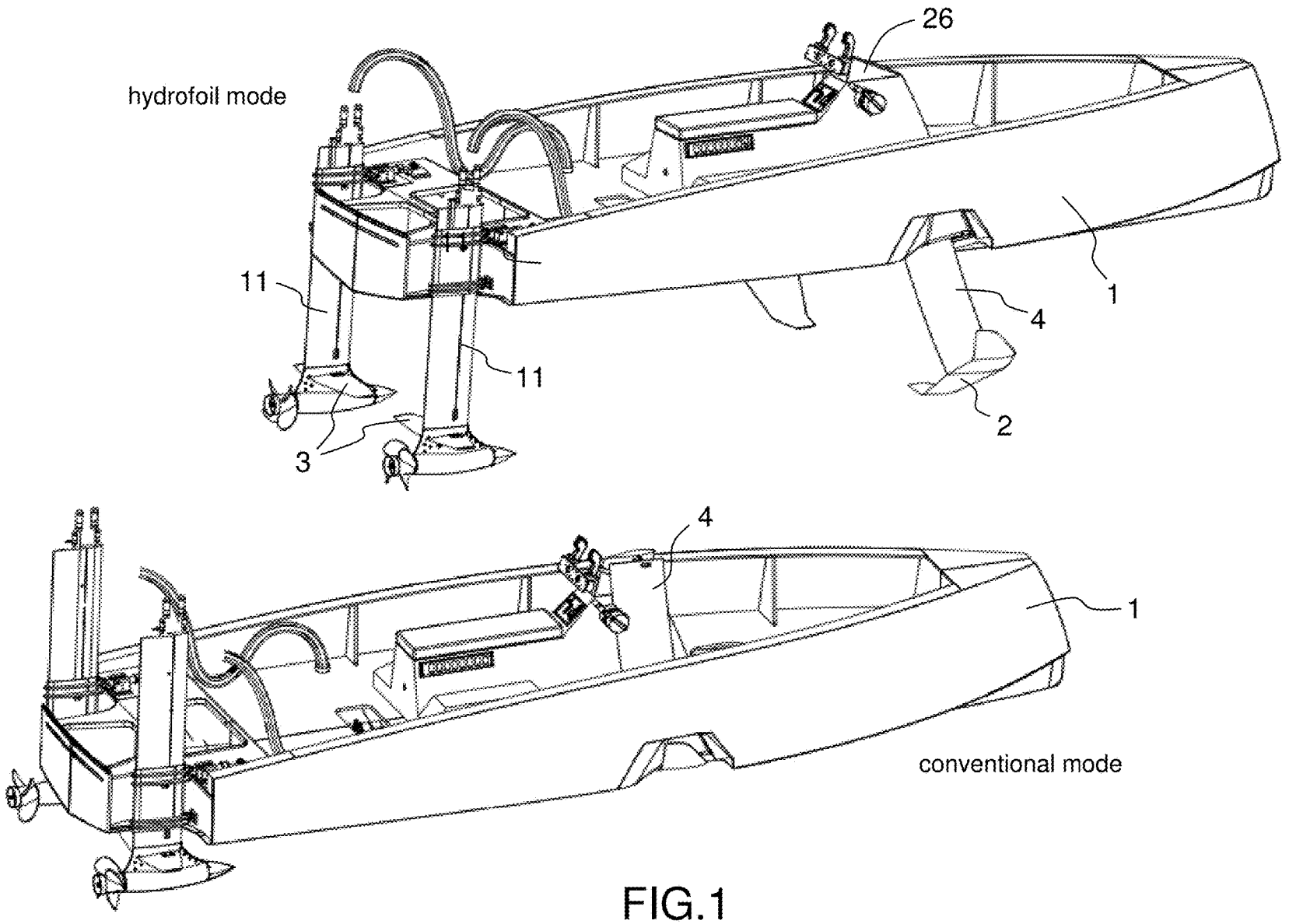
FIG. 1 shows a perspective side view of the hydrofoil boat in hydrofoil mode and in the conventional mode.
Figure 2:
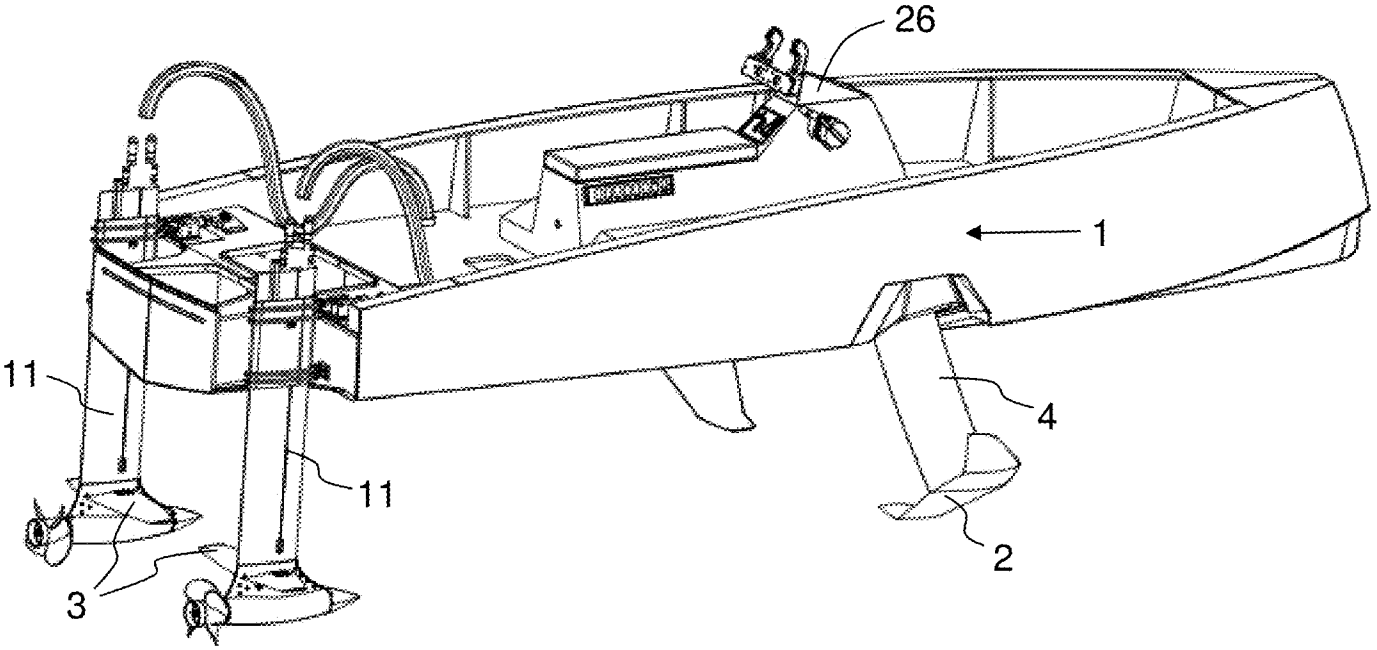
FIG. 2 shows a perspective side view of the hydrofoil boat in hydrofoil mode.
Figure 3:
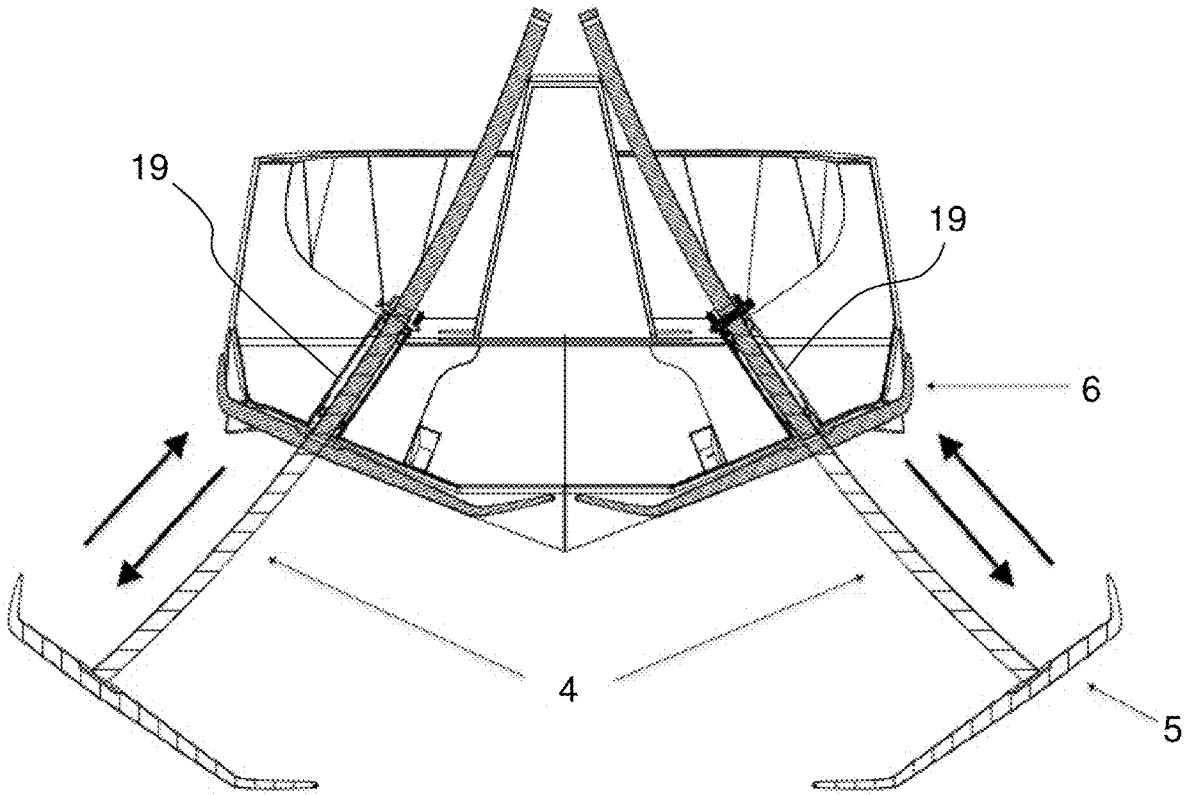
FIG. 3 shows a cross-sectional view of the hydrofoil boat.

The invention relates more precisely to a motor boat comprising a bearing structure and at least one foil, defined by a wing and its support, which is arranged below said structure and slideably mounted with respect thereto; characterized in that the foil is also mounted so as to adopt at least two fixed positions, namely a position referred to as the active position in which the foil is lowered and a position referred to as the passive position in which the foil coincides with the bearing structure or is entirely retracted inside the latter.

Preferably, but not exclusively, the boat according to the invention comprises the following elements, taken in isolation or in combination (cf. FIGS. 2 to 5):

A bearing structure 1.

At least one foil 2 and one stabilizer 3, possibly combined as a single bearing device (for example delta wing), which are arranged below the bearing structure 1 and adapted to bear on the water so as to support and balance the bearing structure 1 when the boat moves on the water, the foil 2 being slideably mounted with respect to the bearing structure 1, along a trajectory substantially perpendicular to the underside of the bearing structure 1, between, on the one hand, a position referred to as the active position where the foil 2 is lowered and, on the other hand, a passive position where the foil 2 is embedded in the bearing structure 1.

A system for the sliding of a curved support 4 which makes it possible to rapidly switch from the passive position to the active position of the foils 4 along a arcuate trajectory, the latter having to satisfy the autostability rules of so-called first-generation hydrofoils with traversing V foils 6.

A system for the retractability of the foils 2 which is activatable when the boat is in operation, with the incidence of the foil 2 with respect to the flow remaining substantially identical throughout the action of rising or lowering of the foils 2.

An improvement in the behavior and comfort onboard the boat by using automatic piloting and/or correction systems which act according to the parameters indicated by an onboard simulator, for example of the dynamic performance prediction (DPP) type which was developed by the applicant. This system in particular makes it possible to simulate the future behavior of the boat starting from a given equilibrium position and from new events (control action, state of the sea, wind, etc.).

Apart from the fact that the motor boat according to the invention offers all the advantages of a boat with foils (reduction in drag at high speed, improvement in onboard comfort in certain sea conditions, maneuverability) its change of configuration offers other advantages, in particular:

Reduction in draft on approaching shallow waters.

Reduction in drag at low speed.

Reduction in the overall size of the boat (in particular the width) during maneuvers, circulation in limited spaces, storage.

Docking similar in all respects to a conventional boat, without recourse to dedicated and complex logistics inherent to boats with foils, and more particularly to boats with traversing V foils termed first-generation hydrofoils.

No restriction in the condition of use specific to a hydrofoil in the sense where the boat can at any time return to a retracted foil configuration and navigate in the same way and with the same limits as a conventional boat of the same category.

Figure 4:
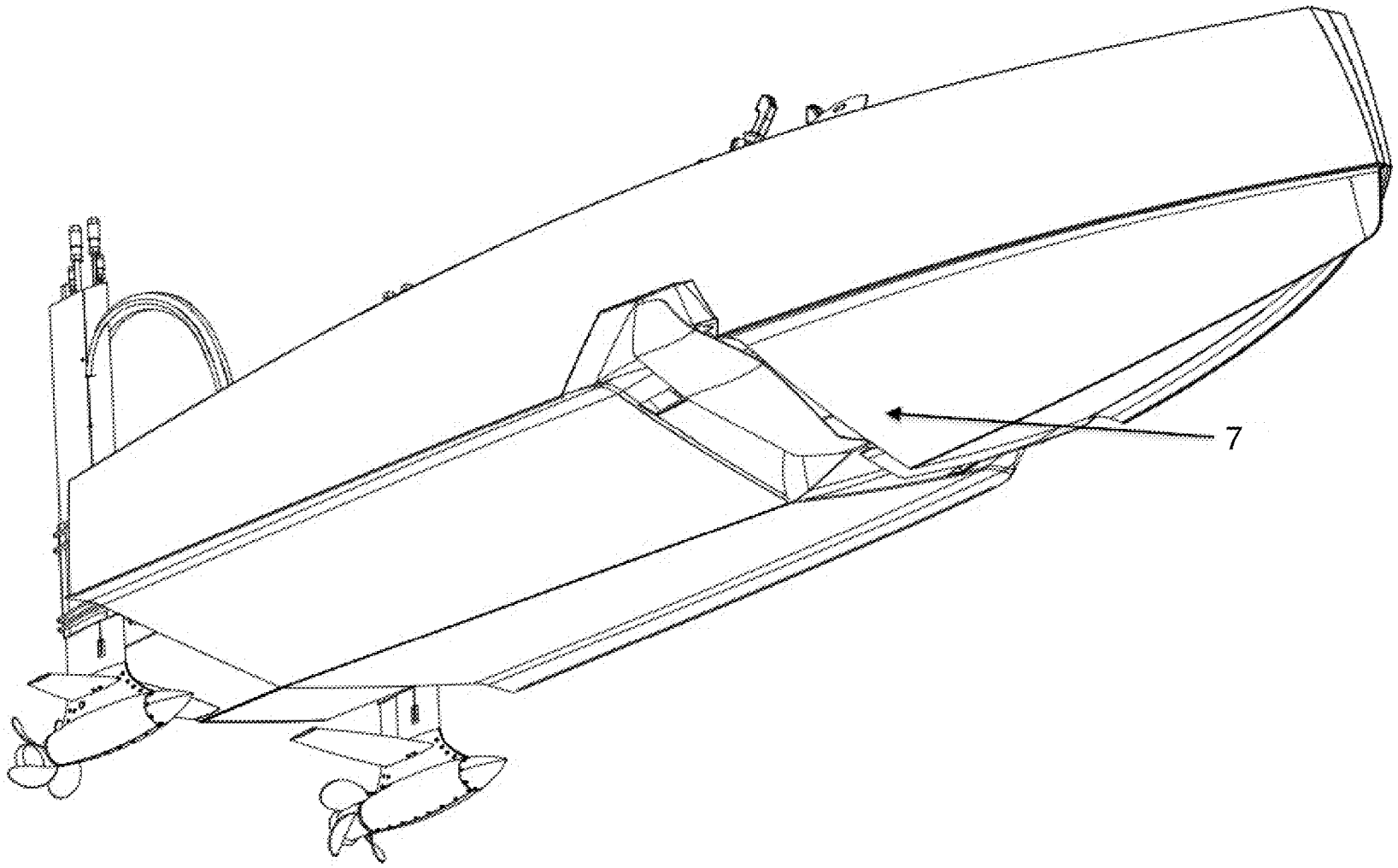
FIG. 4 shows a perspective bottom view showing retracted foils in the conventional mode.

The foils can be housed in the hull in the upper position, behind a recess in the submerged part of the vessel, which also makes it possible to effectively reduce the drag induced by the foils when the boat is in the Archimedean configuration 7 (cf. FIG. 4).

According to another embodiment of the invention, the foils are guided by two blocks 19 having an arcuate shape adapted in that they allow the passage of sails of varying chord and twist.

Advantageously, the system for mechanically raising the foils comprises a screw jack secured to the bearing structure and to the foil simultaneously.

The system for mechanically raising the rudders may comprise a screw jack secured to the bearing structure and to the foil simultaneously.

In a more general manner, any other lifting/lowering system (hydraulic jacks, pulley blocks, racks, etc.) can be used.

Figure 5:
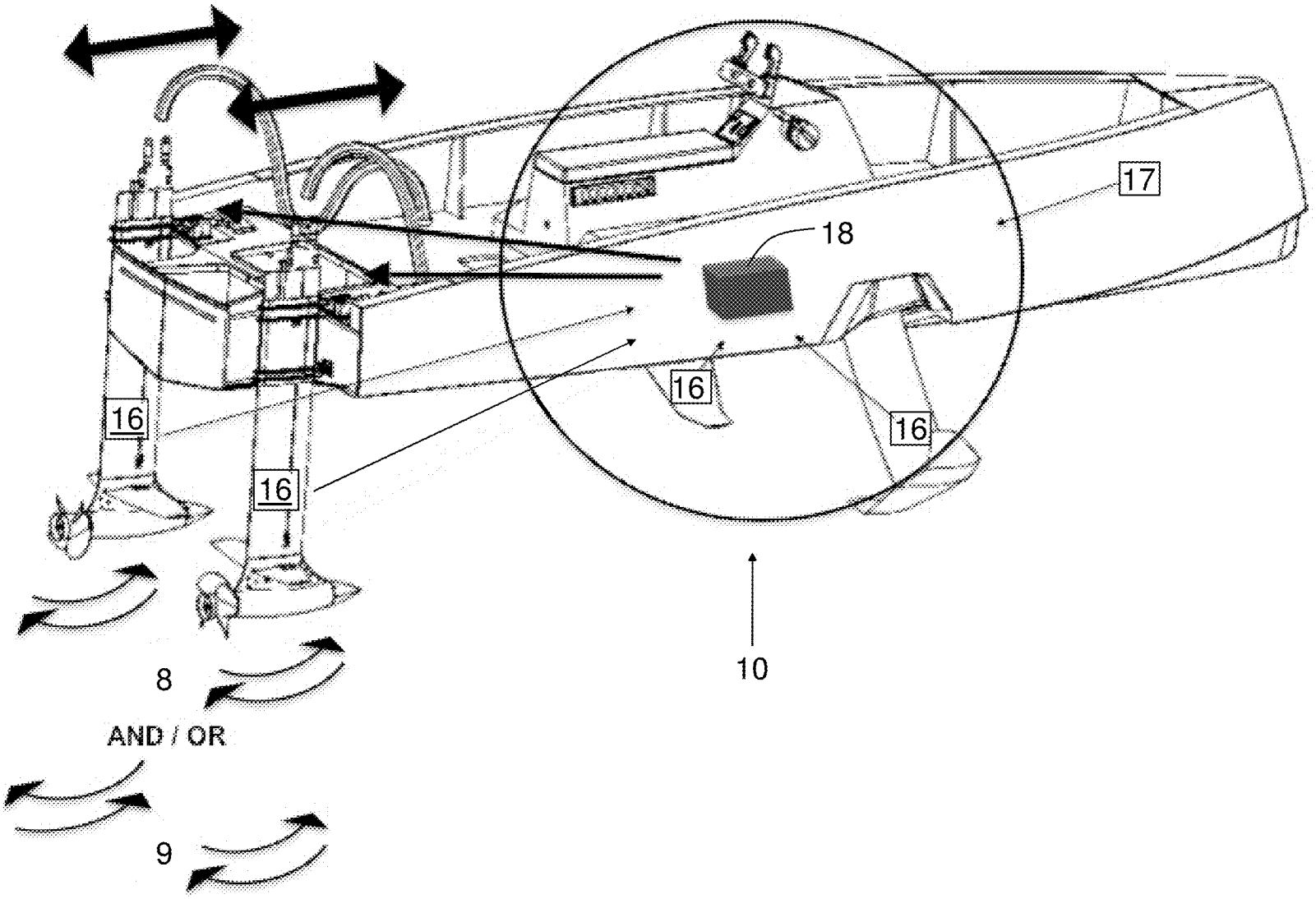
FIG. 5 shows a perspective side view showing locations of load and movement sensors.

In order to improve the behavior of the boat and/or to optimize the performance thereof, the rudders can be controlled to rotate about the lateral axis. This system makes it possible either to modify the trim of the boat by bringing into incidence the bearing planes positioned at the bottom of the rudder 8 to pitch them up or to pitch them down in an identical manner, or to modify the rolling of the boat by asymmetrically modifying the incidences of the port-side and starboard-side bearing plates 9. Advantageously, the movements for controlling the pitching and the rolling can be coupled to provide a complete response to the dynamics of the desired movement. In this configuration, it is required to know the position of the boat. To this end, a gyrocompass can be installed onboard to measure the pitching and the rolling. The gyrocompass provides measurement information which can be converted into a control order to adjust the rotational positioning of the rudders. These operations can of course be automated 10. (FIG. 5). For example, FIG. 5 shows load sensors 16 and motion sensors 17 that are in operative connection with the embedded simulator DPP 18.

In another preferred embodiment of the invention, use is made of a dynamic simulator 10, capable of predicting the dynamic behavior and the seakeeping under all navigation conditions. This simulator, known as a dynamic performance prediction (DPP) simulator and developed by the applicant, is used upstream in order to define and optimize the design of the boat (positions, profiles, characteristics, etc.). It also makes it possible to provide the parameters necessary for configuring the feedback loops of the onboard automatic pilots. Finally, advantageously, the simulator can be used in an onboard manner in order to provide directly the script to be executed by the automaton. In this mode of operation, the simulator is supplied with the information from the onboard sensors and permanently calculates the future states of the boat, which allows it to provide the appropriate instructions to the onboard controls to achieve the desired operating state which may be an attitude of the boat, a performance, the following of a programmed route, a predefined driving mode etc.

Preferably, the automaton comprises a dynamic solver to convert the input from the gyrocompass into a rotational command on the rudders. The automaton is then capable of predicting the change in the forces on the boat and thus of incorporating into the command of the controller notions such as the geometry of the appendages or of the boat. In the present case, the autostable geometry of the foils allows the controller to reduce the oscillations and to reduce the time necessary to obtain the targeted state.

The dynamic solver solves the equations of the movement with six degrees of freedom. However, these equations can be simplified (linearization of the equations) as a function of the performance of the numerical resolution. The numerical scheme will preferably be an adapative time step scheme, although the performance of the resolution will adapt this choice and will be able to allow the use of a numerical scheme of the Runge-Kutta type or other methods of the scientific literature.

The models resolving the forces must be adapted to the craft controlled by the autopilot, and consequently the geometries of the boat must be introduced into the simulator by means of files of the CAO file or text file type of a suitable format.

Advantageously, the command order given by the automaton is transmitted to the rudders in the form of hydraulic power. A hydraulic pump converts the electrical command order from the automaton in the form of hydraulic pressure. Jacks convert the hydraulic power into rotational movement of the rudders and thus ensure that the behavior of the vehicle is optimized.

The command mode can also be provided by other means, electrical jacks, racks, etc.

The propulsive apparatus is included in bulbs at the bottom of the rudders 11. The propulsive apparatus must be permanently submerged both in Archimedean and deployed-foil configuration. It must additionally rise into an upper position, that is to say one closer to the bearing structure during the Archimedean configuration to reduce the draft.

Figure 6:
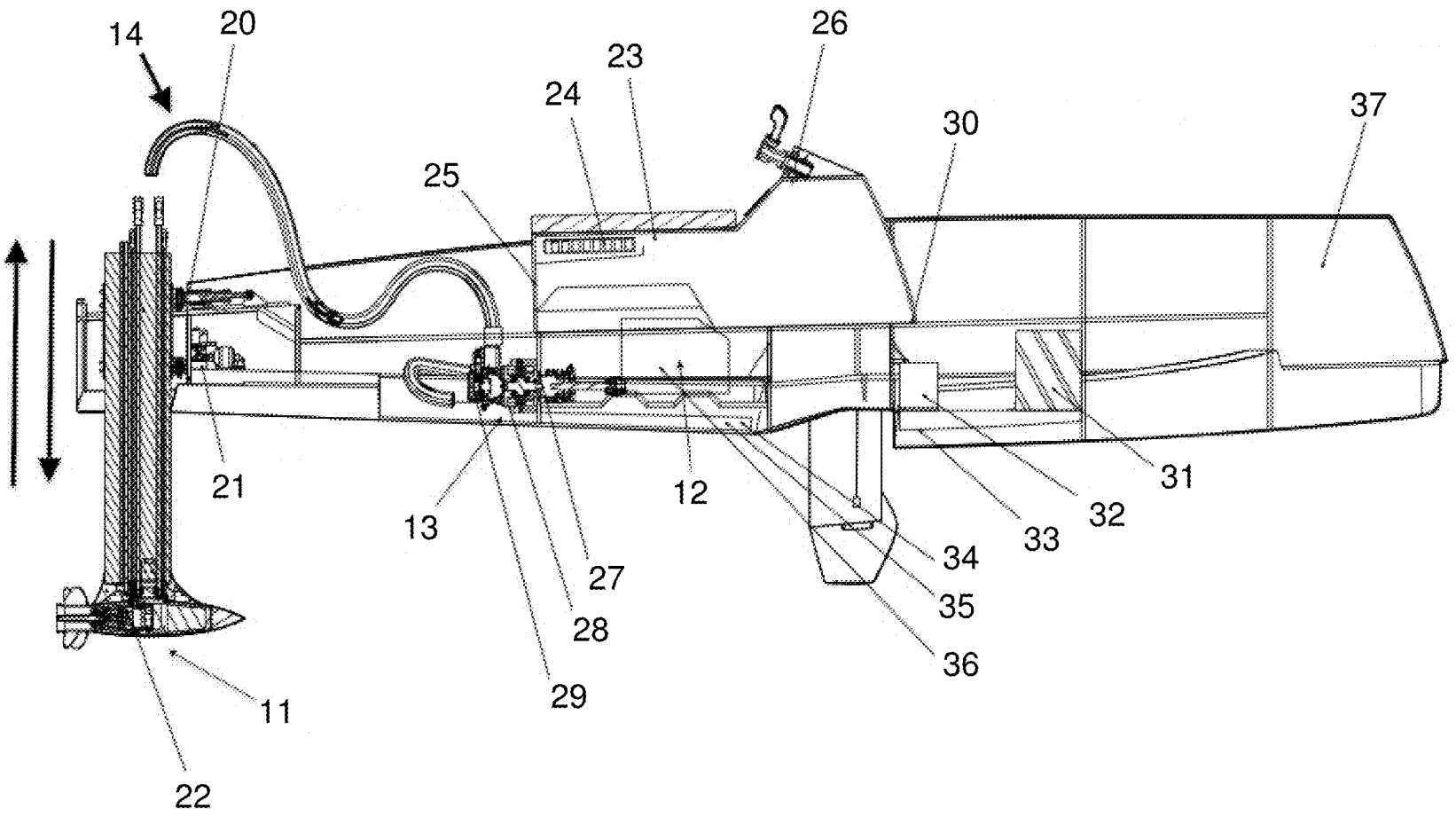
FIG. 6 shows a side view of the hydrofoil boat showing different elements of the system.

The propulsive apparatuses receive the power supplied by the engine of the vehicle to the bottoms of the rudders. The rudders are translatable vertically so as to be able to be raised into an upper position. In order to advantageously transmit the power and provide the torque necessary for the boat to lift off, an engine, for example a combustion engine 12, coupled to hydraulic pumps 13 is installed. These hydraulic pumps lead the hydraulic power through the rudders by means of flexible hoses 14. The propulsive apparatus is composed of a hydraulic generator and of a propeller. FIG. 6 also shows the following elements of the boat: servo jacks 20, servo valves 21, hydraulic motors 22 (two Bondioli M4MF37-37cc-26kW), engine compartment fan 23, obstruction engine ventilation grill 24, extinguishing orifices 25, control console 26 for steering, fuel, alarms, circuit breakers, and screen, cooling pump 27 (Jabsco 40-3/4"), geared distribution box 28, hydraulic pumps 29 (2 Bondioli HPP223-23cc), ventilation battery compartment 30, oil reservoir 31 (451), battery pack 32 (2 2SAh), front hold compartment pump 33, water rise alarm 34, rear hold compartment pump 35, combustion engine 36 (Weber MPE850 120 HP), and anchor well 37.

It goes without saying that the invention is not limited to the examples described and illustrated in the present document. It covers any type of mechanism which makes it possible to modify the position of the foils during navigation as defined in the claims.

The invention claimed is:

1. A motor boat comprising:

a bearing structure and a foil including a wing and a support, the foil being arranged below the bearing structure and slideably mounted with respect to the bearing structure, wherein the foil is configured to adopt two fixed positions including an active position in which the foil is lowered away from the bearing structure for hydrofoil boat operation, and a passive position in which the foil coincides with the bearing structure or is entirely retracted inside the bearing structure, and wherein the foil is configured to slide from the active position to the passive position and vice versa along an arcuate trajectory.

2. The motor boat as claimed in claim 1, wherein the foil is configured to slide when the motor boat is moving, while retaining a constant orientation with respect to a flow of water around the motor boat.

3. The motor boat as claimed in claim 1, wherein in the passive position, at least one part of the support is visible from a control station of the motor boat.

4. The motor boat as claimed in claim 1, wherein the support has an arcuate shape that is slidably engaging with an arcuate shaped block, the arcuate shaped block having an opening such that an upper end of the support is configured to protrude out of the arcuate shaped block in the passive position.

5. The motor boat as claimed in claim 1, wherein the wing of the foil includes two end wings, one end wing being arranged horizontally, the other one vertically when the foil is in the active position.

6. The motor boat as claimed in claim 1, further comprising:

a cockpit, wherein the foil includes a first and a second foil having a first and second support, respectively, the first and the second support arranged axis-symmetrically respect to a longitudinal axis of the motor boat.

7. The motor boat as claimed in claim 6, wherein when the first and the second foil are in a passive position, the cockpit lies between the first and the second support of the first and the second foil, respectively.

8. The motor boat as claimed in claim 6, wherein a convex side of the first support is facing a convex side of the second support.

* * * * *